United States Patent [19]

Reed, Jr.

[11] Patent Number: 4,670,070

[45] Date of Patent: Jun. 2, 1987

[54] METHOD OF MAKING A REMOVABLE MASK KACHINA DOLL

[76] Inventor: John C. Reed, Jr., 412 N. McCarran #485, Sparks, Nev. 89431

[21] Appl. No.: 669,226

[22] Filed: Dec. 26, 1984

[51] Int. Cl.[4] ..... B44C 3/06

[52] U.S. Cl. ..... 156/61; 156/63; 156/91; 428/16; 428/542.2; 434/82; 434/267; 446/87; 446/385

[58] Field of Search ..... 2/206; 29/805; 156/59, 156/250, 61, 63, 91; 428/15, 16, 542.2; 434/82, 267; 446/85, 87, 88, 97, 99, 100, 385

[56] References Cited

U.S. PATENT DOCUMENTS 2,506,328 5/1950 Alger ..... 446/100 X
3,419,993 1/1969 Rodgers ..... 446/100
4,380,336 4/1983 Pratt ..... 446/87 X

OTHER PUBLICATIONS

Wright, "Hopi Kachinas", Northland Press, Flagstaff, AZ, 1977.

*Primary Examiner*—Robert A. Dawson
*Attorney, Agent, or Firm*—John C. Reed, Jr.

[57] ABSTRACT

A method of forming a decorative doll or figurine is disclosed that uses many parts such as the torso, upper and lower arm, upper and lower legs, feet, hands, head and an encasing mask that is placed over the head of the doll. The mask is easily removed from the doll and the single doll can be changed into many by changing the mask style to form a different decorative doll or figurine.

4 Claims, 6 Drawing Figures

METHOD OF MAKING A REMOVABLE MASK KACHINA DOLL

BACKGROUND DESCRIPTION OF THE INVENTION

This invention relates to a method of making a doll or figurine such as a Kachina doll comprising the steps of forming the doll out of many pieces to form a decorative doll with an encasing mask that can be removed and replaced in such a way as to form other types of dolls. This type of doll has been made for many years but always out of one piece of wood without the mask that comes off. This invention teaches a new method of forming the doll in a way that takes less time thus making it possible for manufacturing at a very low cost and being able to sell at a very low price so all who would like to to have one would be able to have it.

DESCRIPTION OF PREFERRED EMBODIMENTS

Figure 1:
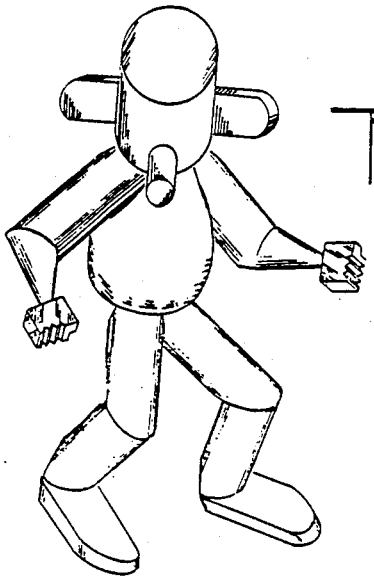
FIG. 1 illustrates the Kachina doll completely assembled and the encasing mask on the doll.
Figure 2:
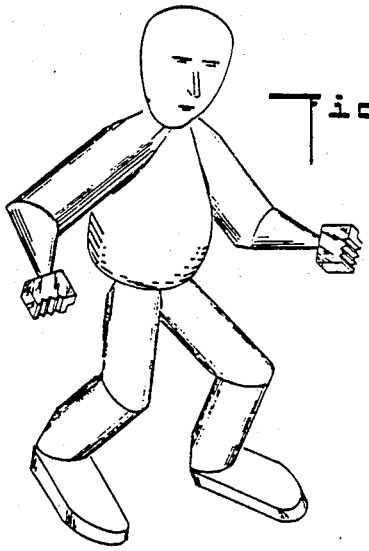
FIG. 2 is an illustration of the doll complete but with the encasing mask off.
Figure 3:
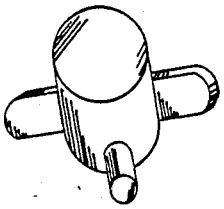
FIG. 3 is a view of the encasing mask complete and off the doll.
Figure 4:
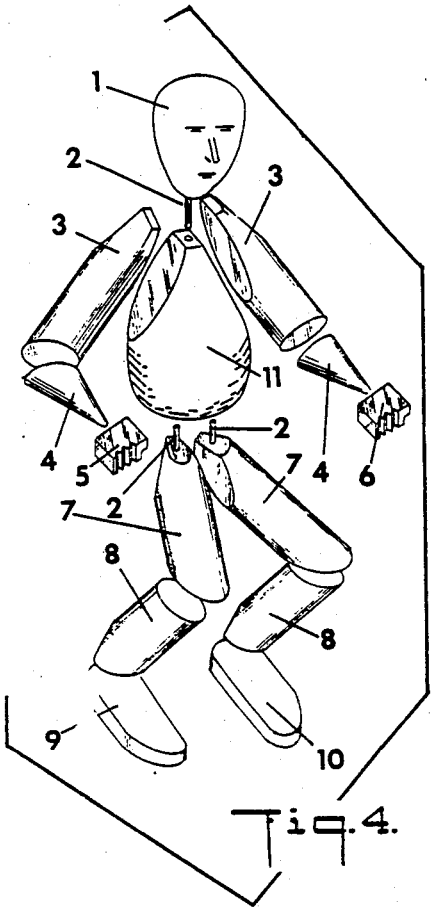
FIG. 4 Is an exploded view of the doll showing, 1—the head, 2—the pins 3—the upper arm parts, 4—are the lower arm parts, 5—is the right hand, 6—is the left hand, 7—the upper leg parts, 8—lower leg parts, 9—is the right foot, 10—is the left foot, 11—is the torso.
Figure 5:
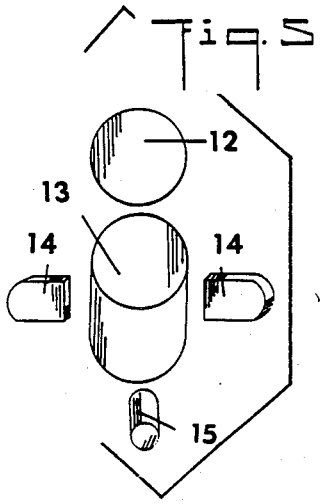
FIG. 5 is the exploded view of the encasing mask, 12—is the top of the mask 13—is the head of the encasing mask, 14—are the ears, 15—is the nose.
Figure 6:
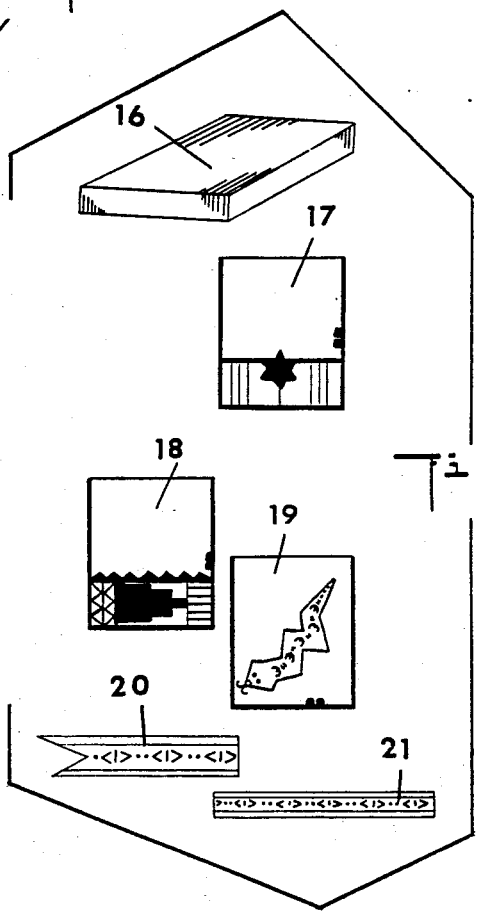
FIG. 6 is a view of the parts of the dress and base to hold the Kachina doll up; 16—is the base, 17—is the star skirt, 18—is the rain skirt, 19—is the snake skirt, 20—is the sash and 21—is the belt.

The invention is a wood doll carved and put togeather in at least 14 pieces of wood as shown in FIG. 4. The wood pieces can be made in any size to make the doll larger or smaller. The wood pieces may also be used to form molds and the doll pieces may be cast in any casting material. The doll is preferably glued togeather by a hot melt glue. The mask is typically made of cardboard tube and pieces are glued with hot melt glue to complete the doll.

BEST MODE OF CARRYING OUT THE INVENTION

This invention can best be done by carving out the pieces of the doll from a soft kiln dried wood such as Balsa wood. After the pieces are carved they could be molded and cast out of different cast materials. The mask is made out of wood and a cardboard tube and glued togeather with hot melt glue.

What is claimed is:

1. A method of making a doll or figurine assembly comprising the steps of:

(A) forming body and head portions for the doll or figurine from separate pieces for each of the torso, upper arms, lower arms, hands, upper legs, lower legs, feet and head;

(B) securing said pieces togeather to form a complete doll assembly;

(C) forming a head encasing mask from separate pieces for a nose, ears, head and top of head secured together;

(D) decorating said assembly and said mask and:

(E) removably securing the mask and assembly to form a completed doll or figurine.

2. A method according to claim 1, wherein adhesive is used to help secure said assembly and said mask.

3. A method according to claim 2, wherein said adhesive is a hot melt adhesive.

4. A method according to claim 1, or claim 2, wherein said securing is preformed with separate mechanical fastening means.

* * * * *